United States Patent [19]

Roy

[11] Patent Number: 4,848,312

[45] Date of Patent: Jul. 18, 1989

[54] SAFETY ACCESSORY FOR A FIELD RANGE

[76] Inventor: James N. Roy, 405 Cottonwood St., Rock Springs, Wyo. 82901

[21] Appl. No.: 208,700

[22] Filed: Jun. 20, 1988

[51] Int. Cl.[4] ..... F24C 15/10

[52] U.S. Cl. ..... 126/37 B; 126/37 R; 126/39 B; 126/39 C; 126/42; 312/216

[58] Field of Search ..... 126/37 R, 9 R, 37 A, 126/37 B, 39 R, 39 A, 39 C, 39 M, 275 R, 275, 30, 42; 431/154, 155; 312/216, 107.5, 221

[56] References Cited

U.S. PATENT DOCUMENTS

| | | | |
|---|---|---|---|
| 1,987,378 | 1/1935 | Tansley | 220/6 |
| 2,391,460 | 12/1945 | Howard | 126/1 |
| 3,199,937 | 8/1965 | Mitchell | 312/221 |
| 3,354,878 | 11/1967 | Balls | 126/275 |
| 4,092,973 | 6/1978 | Bernazzani | 126/37 B |
| 4,429,930 | 2/1984 | Blouin | 312/216 |
| 4,732,433 | 3/1988 | Bruneau | 312/221 |

*Primary Examiner*—James C. Yeung
*Attorney, Agent, or Firm*—Henderson & Sturm

[57] ABSTRACT

A safety accessory (10) used in combination with a field range (100) having a plurality of burner units (101); wherein, the safety accessory (10) includes an elongated shaft member (14) pivotally secured to the side (103) of the field range (100) and having rod elements (15) that project into the interior of the field range (100) to allow only one burner unit (101) to be operatively installed on either the upper (104) or lower (105) shelf elements of the field range (100).

2 Claims, 1 Drawing Sheet

SAFETY ACCESSORY FOR A FIELD RANGE

TECHNICAL FIELD

This invention relates in general to a safety device for a portable field range, and in particular to a safety device for a portable field range which will not allow two burners to be present simultaneously in the field range.

BACKGROUND OF THE INVENTION

The present invention was the subject matter of Document Disclosure Program Registration No. 180476 that was submitted to the U.S. Pat. and Trademark Office on Nov. 6, 1987.

As can be seen by reference to the following U.S. Pat. Nos.: 4,092,973; 3,354,878; 2,391,460; and, 1,987,378 the prior art is replete with myriad and diverse field range accessories which are designed to operate on a portable field range.

While the prior art constructions are more than adequate for the purpose and function for which they were specifically designed, they do suffer from a number of shared deficiencies.

For instance, all of the prior art constructions that are adapted to receive burners in two separate locations within the field range lack a safety feature that prohibits the simultaneous insertion of both burners. This deficiency can be very dangerous, due to the fact that when the lower burner is ignited below another burner, the upper burner may quickly overheat and will likely explode, causing irreparable damage to the field range, and possibly injuring those persons attending the field range.

Obviously, there has been a longstanding need for a field range construction which incorporates a safety feature to prohibit the simultaneous presence of two burners within a given field range; and, the development of such a device is the stated purpose and objective of the present invention.

BRIEF SUMMARY OF THE INVENTION

The present invention involves in general a safety accessory for a field cooking range assembly. The safety accessory that forms the basis of this invention comprises in general: a shaft unit, a support unit, and a pair of hinged units. The shaft unit comprises an extended rod member; wherein, a foot member projects inwardly from each end of the rod member.

The support unit comprises in general: a pair of anchoring members and a rotating axle member; wherein, the anchoring members are attached to one side of the field range construction in a side-by-side configuration so that the axle member may extend between the anchoring members.

The midpoint of the axle member is connected proximate to the midpoint of the shaft unit; wherein, the shaft unit may pivot around the axle member, in a well recognized fashion.

Each of the hinged units comprises in general: a base member, a hinge member, and an extension member; wherein, the hinge member is disposed between the base member and the extension member, so that the extension member may pivot freely relative the base member. The base member is fixedly attached to the side wall of the field range, so that the extension member covers the hold through which the foot portions of the shaft member project.

The arrangement was specifically developed such that when a burner is placed in the field range, in either the upper or lower position, the base of the burner pushes against the extension member of the hinge unit, therein causing one foot of the shaft member to move outward. This outward movement of one foot causes the shaft unit to pivot about the axle member of the support unit, thus forcing the opposite foot inward. The inward movement of the other foot projects the extension member of the corresponding hinged unit inwardly, subsequently blocking the insertion of an additional burner unit into the field range and thereby creating a potentially hazardous situation.

BRIEF DESCRIPTION OF THE DRAWINGS

These and other objects, advantages, and novel features of the invention will become apparent from the detailed description of the best mode for carrying out the preferred embodiment of this invention which follows; particularly when considered in conjunction with the accompanying drawings, wherein.

BEST MODE FOR CARRYING OUT THE INVENTION

Figure 1:
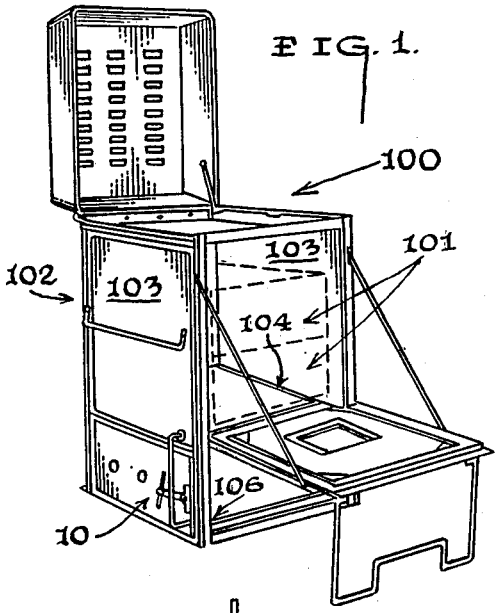
FIG. 1 is a perspective view of a field range construction with the safety device of the present invention deployed in its intended environment.

As can be seen by reference to the drawings and in particular to FIG. 1, the safety accessory that forms the basis of the present invention is designated generally by the reference numeral (10); and, this safety accessory was developed specifically for use with a military field range designated generally by the reference number (100).

Prior to embarking upon a description of the safety accessory (10), it would be helpful to endeavor to describe the salient features of a typical military field range (100). To begin with, the field range (100) depicted in FIG. 1 represents an older model of a type designated by the U.S. Army as an M-59 field range (100) which employs a pair of M-2 burner units (101) depicted in phantom.

As can be seen by reference to FIG. 1, the field range (100) comprises a generally rectangular housing member (102) having vertical sides (103) and upper (104) and lower (105) shelf elements which will support under normal circumstances one of the burner units (101). It can also be appreciated by reference to FIGS. 1, that the normal mode of operation of the field range (100) is to have only one of the burner units (101) deployed within the field range (100) on either the upper (104) or lower (105) shelf elements; however, both of the burner units (101) can be supported on the upper shelf elements (104) when the field range (100) is being transported into the field for use.

As mentioned previously, the safety accessory (10) of this invention was specifically designed to insure that only one of the burner units (101) can be deployed in the field range (100) when the field range (100) is in actual use.

Figure 2:
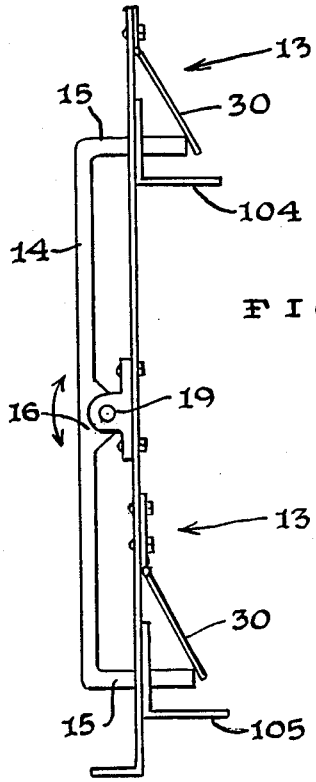
FIG. 2 is an enlarged detail view of the safety accessory when no burners are present in the field range.
Figure 3:
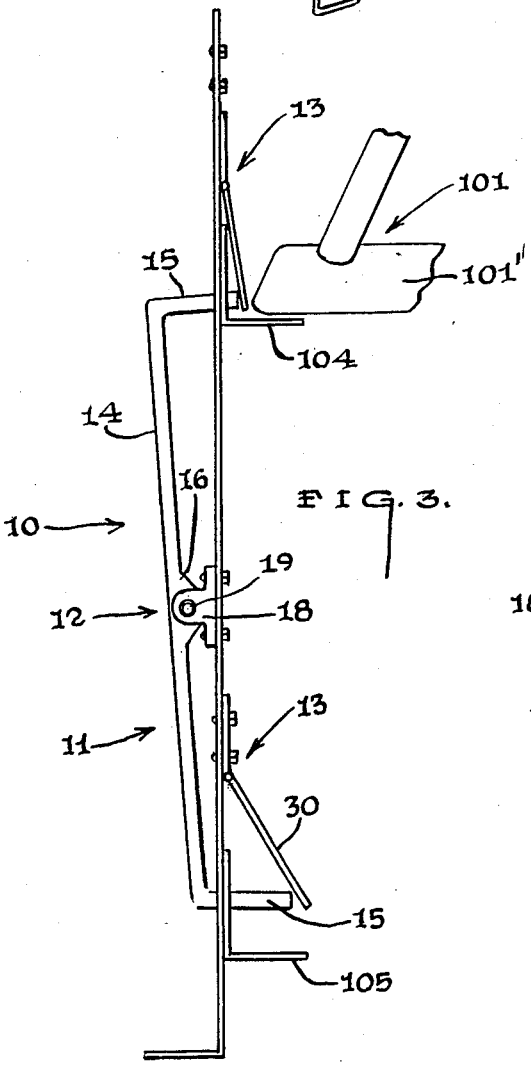
FIG. 3 is an enlarged detail view of the safety accessory when one burner is present; and, FIG. 4 is an isolated side plan view of the safety accessory.
Figure 4:
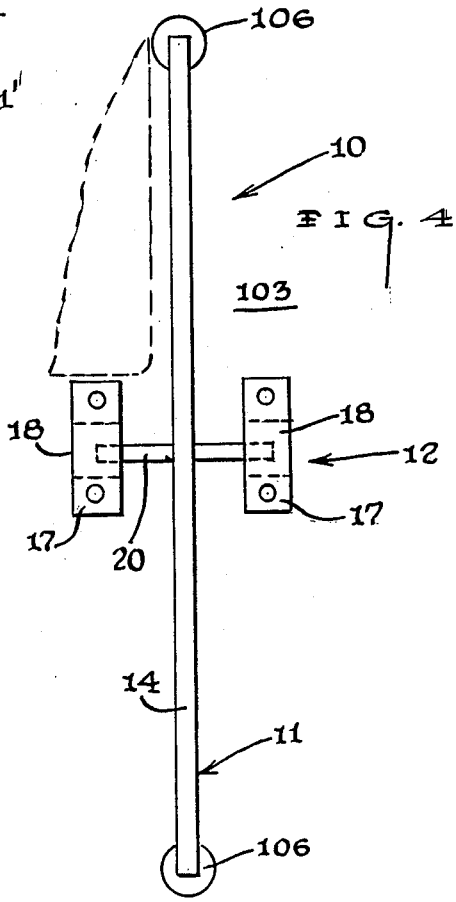

Turning now to FIGS. 2 thru 4, it can be seen that the safety accessory (10) comprises in general: a shaft unit (11), a support unit (12), and a pair of hinge units (13). These units will now be described in seriatim fashion.

As shown in FIGS. 2 and 3, the shaft unit (11) comprises an elongated shaft member (14) having inwardly projecting extension rod elements (15) formed on its outboard ends; and, an apertured central portion (16) disposed proximate its midpoint.

The support unit (12) comprises a pair of bracket members (17) secured to at least one of the sides (103) of the field range (100) and having outwardly projecting apertured ear elements (18); wherein, the apertures (19) in the ear elements (18) are dimensioned to receive an axle member (20). In addition, the axle member (20) is further dimensioned to be received within the apertured central portion (16) of the elongated shaft member (14); wherein, the generally C-shaped shaft member (14) is pivotally associated with at least one of the sides (103) of the field range (100).

As can best be appreciated by reference to FIGS. 2 and 4, the sides (103) of the field range (100) are provided with enlarged apertures (106) adjacent to the upper (104) and lower (105) shelf elements of the field range (100) in accordance with the teachings of this invention; wherein, the inwardly projecting rod elements (15) of the elongated shaft member (14) extend over the shelf elements (104)(105) when the safety accessory (10) is in its at rest position relative to the field range (100).

At this juncture, it should be noted that the shaft unit (11) and the support unit (12) of the safety accessory (10) will cooperate in conjunction with the field range (100) and one of the burner units (101), to allow the safety accessory (10) to operate in its intended manner without the addition of the aforementioned plurality of hinged units (13).

However, in the preferred embodiment of this invention illustrated in the drawings, the hinge units (13) are included to insure that the safety accessory (10) will function in its intended mode of operation. As shown in FIGS. 2 and 3, the hinge units (13) comprise a pair of hinged panels (30) disposed on the interior of at least one of the sides (103) of the field range (100); wherein, the hinged panels (30) are positioned respectively above the upper (104) and lower (105) shelf elements; and, in an opposed relationship with the enlarged apertures (106) in one side (103) of the field range (100).

Given the close tolerances between the sides (103) of the field range (100) and the base (101') of the fuel units (101) when one of the fuel units (101) is inserted onto one of the shelf elements such as (104), the hinged panel (30) will be forced against one of the extension rod elements (15), thereby pivoting the elongated shaft member (14) to force the other extension rod element (15) inwardly against the other hinged panel (30) to prevent a second fuel unit (101) to be inserted into the unoccupied shelf elements (105).

Having thereby described the subject matter of this invention it should be apparent that many substitutions, modifications, and variations of this invention are possible in light of the above teachings. It is therefore to be understood that the invention as taught and described herein is only to be limited to the extent of the breadth and scope of the appended claims.

I claim:

1. A safety accessory in combination with a field range having vertical sides including upper and lower shelf elements and enlarged apertures formed in at least one of the sides of the field range adjacent the shelf elements and a pair of burner units adapted for use with the field range wherein the safety accessory comprises:

a support unit including at least one bracket member having an apertured ear element operatively associated with an axle member wherein said at least one bracket member is secured to said at least one of sides of the field range; and, a shaft unit including an elongated shaft member pivotally secured to said axle member and having inwardly projecting extension rod elements formed on the ends of the shaft member; wherein, the extension rod elements project through the enlarged apertures adjacent said upper and lower shelf elements to prevent more than one of said burner units from being operatively deployed within said field range.

2. The safety accessory of claim 1 further comprising a pair of hinge units wherein each of said hinge units comprises a hinged panel secured to the interior of said field range at locations adjacent to said shelf elements and opposite said enlarged apertures in said at least one side of the field range.

* * * * *